US010650948B2

(12) United States Patent
Kim

(10) Patent No.: US 10,650,948 B2
(45) Date of Patent: May 12, 2020

(54) INDUCTOR

(71) Applicant: SAMSUNG ELECTRO-MECHANICS CO., LTD., Suwon-si, Gyeonggi-do (KR)

(72) Inventor: Jae Hun Kim, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 176 days.

(21) Appl. No.: 15/675,286

(22) Filed: Aug. 11, 2017

(65) Prior Publication Data

US 2018/0114619 A1 Apr. 26, 2018

(30) Foreign Application Priority Data

Oct. 25, 2016 (KR) ..... 10-2016-0139394

(51) Int. Cl.

| | |
|---|---|
| ***H01F 5/00*** | (2006.01) |
| ***H01F 17/00*** | (2006.01) |
| ***H01F 27/29*** | (2006.01) |
| ***H01F 27/32*** | (2006.01) |
| ***H01F 5/04*** | (2006.01) |
| ***H01F 10/06*** | (2006.01) |
| *H01F 17/04* | (2006.01) |

(52) U.S. Cl.

CPC ..... *H01F 5/003* (2013.01); *H01F 5/00* (2013.01); *H01F 5/04* (2013.01); *H01F 10/06* (2013.01); *H01F 17/0013* (2013.01); *H01F 27/292* (2013.01); *H01F 27/323* (2013.01); *H01F 2017/048* (2013.01)

(58) Field of Classification Search

CPC ..... H01F 27/00–36; H01F 5/00

USPC .... 336/65, 83, 192, 196, 200, 206–208, 232

See application file for complete search history.

(56) References Cited

U.S. PATENT DOCUMENTS

| | | | | |
|---|---|---|---|---|
| 9,142,343 | B2 * | 9/2015 | Ohkubo | H01F 27/2804 |
| 9,437,363 | B2 * | 9/2016 | Choi | H01F 17/0013 |
| 9,472,608 | B2 * | 10/2016 | Lee | H01L 28/10 |
| 9,490,062 | B2 * | 11/2016 | Yoon | H01F 17/0013 |

(Continued)

FOREIGN PATENT DOCUMENTS

| | | | |
|---|---|---|---|
| CN | 104078221 | A | 10/2014 |
| JP | 09-252087 | A | 9/1997 |

(Continued)

OTHER PUBLICATIONS

Office Action issued in corresponding Korean Patent Application No. 10-2016-0139394, dated Dec. 20, 2017, with English Translation.

(Continued)

*Primary Examiner* — Tuyen T Nguyen

(74) *Attorney, Agent, or Firm* — Morgan, Lewis & Bockius LLP

(57) ABSTRACT

An inductor includes: a body including a coil and a magnetic material, and external electrodes disposed on an outer surface of the body. The coil is supported by a support member, and the support member may also support an insulating wall including an open-hole pattern having a shape corresponding to a pattern of the coil. An insulating ribbon formed so that a length thereof is greater than a width thereof may be additionally disposed on at least a portion of an upper surface of the insulating wall.

23 Claims, 10 Drawing Sheets

(56) References Cited

U.S. PATENT DOCUMENTS

| | | | | |
|---|---|---|---|---|
| 9,595,384 | B2 * | 3/2017 | Nakamura | H01F 17/0013 |
| 9,899,136 | B2 * | 2/2018 | Lee | H01F 5/00 |
| 9,978,501 | B2 * | 5/2018 | Jeong | H01F 27/2804 |
| 10,014,100 | B2 * | 7/2018 | Nakamura | H01F 27/2804 |
| 2013/0222101 | A1 * | 8/2013 | Ito | H01F 17/04 336/83 |
| 2014/0285305 | A1 | 9/2014 | Yoo et al. | |
| 2015/0035634 | A1 | 2/2015 | Nakamura et al. | |
| 2015/0102889 | A1 | 4/2015 | Choi et al. | |

FOREIGN PATENT DOCUMENTS

| | | | |
|---|---|---|---|
| JP | 2008-166455 | A | 7/2008 |
| JP | 5115691 | B2 | 1/2013 |
| JP | 2015-032625 | A | 2/2015 |
| KR | 10-1999-0066108 | A | 8/1999 |
| KR | 10-2001-0001338 | A | 1/2001 |
| KR | 10-1462806 | B1 | 11/2014 |

OTHER PUBLICATIONS

Office Action issued in corresponding Chinese Application No. 201711007656.6, dated Jul. 1, 2019.

* cited by examiner

IV-IV'

INDUCTOR

CROSS-REFERENCE TO RELATED APPLICATION(S)

This application claims benefit of priority to Korean Patent Application No. 10-2016-0139394 filed on Oct. 25, 2016 in the Korean Intellectual Property Office, the disclosure of which is incorporated herein by reference in its entirety.

TECHNICAL FIELD

The present disclosure relates to an inductor and, more particularly, to a thin-film type power inductor advantageous for a small size and high inductance.

BACKGROUND

In accordance with the development of information technology (IT), miniaturization and thinness of an apparatus have been accelerated, and a market demand for a small and thin device has increased.

The following Patent Document 1 provides a power inductor including a substrate having a via hole so as to be suitable for meeting the demand of this technical trend, and coils disposed on both surfaces of the substrate and electrically connected to each other through the via hole of the substrate, in order to provide an inductor having a uniform coil with a large aspect ratio. However, due to limitations of the manufacturing process, there is still a limitation in forming a uniform coil with a large aspect ratio.

SUMMARY

An aspect of the present disclosure may provide an inductor having structural stability and reliability in an entire structure while including a coil having a high aspect ratio.

According to an aspect of the present disclosure, an inductor may include: a body including a magnetic material, a support member, and a coil and insulating walls which are supported by the support member; and external electrodes disposed on an outer surface of the body. The coil may have a lower surface contacting the support member, an upper surface opposing the lower surface, and a side surface connecting the upper and lower surfaces to each other, and the side surface of the coil may contact the insulating walls. An insulating ribbon may be disposed on an upper surface of the insulating walls and the upper surface of the coil to cross from an outermost insulating wall to an innermost insulating wall among the insulating walls.

According to another aspect of the present disclosure, an inductor may include: a body including a magnetic material and embedding a coil; external electrodes disposed on an outer surface of the body and electrically connected to the coil; insulating walls being in contact with a side surface of the coil and having an open-hole pattern having a shape corresponding to the coil; an insulating ribbon disposed on at least a portion of an upper surface of the coil to cross from an upper surface of an outermost insulating wall to an upper surface of an innermost insulating wall among upper surfaces of the insulating walls; and an additional insulating layer disposed on an upper surface of the insulating ribbon and a region of the upper surface of the coil that is not covered by the insulating ribbon.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Hereinafter, exemplary embodiments of the present disclosure will be described in detail with reference to the accompanying drawings.

Hereinafter, an inductor according to an exemplary embodiment in the present disclosure will be described, but is not necessarily limited thereto.

Inductor

Figure 1:
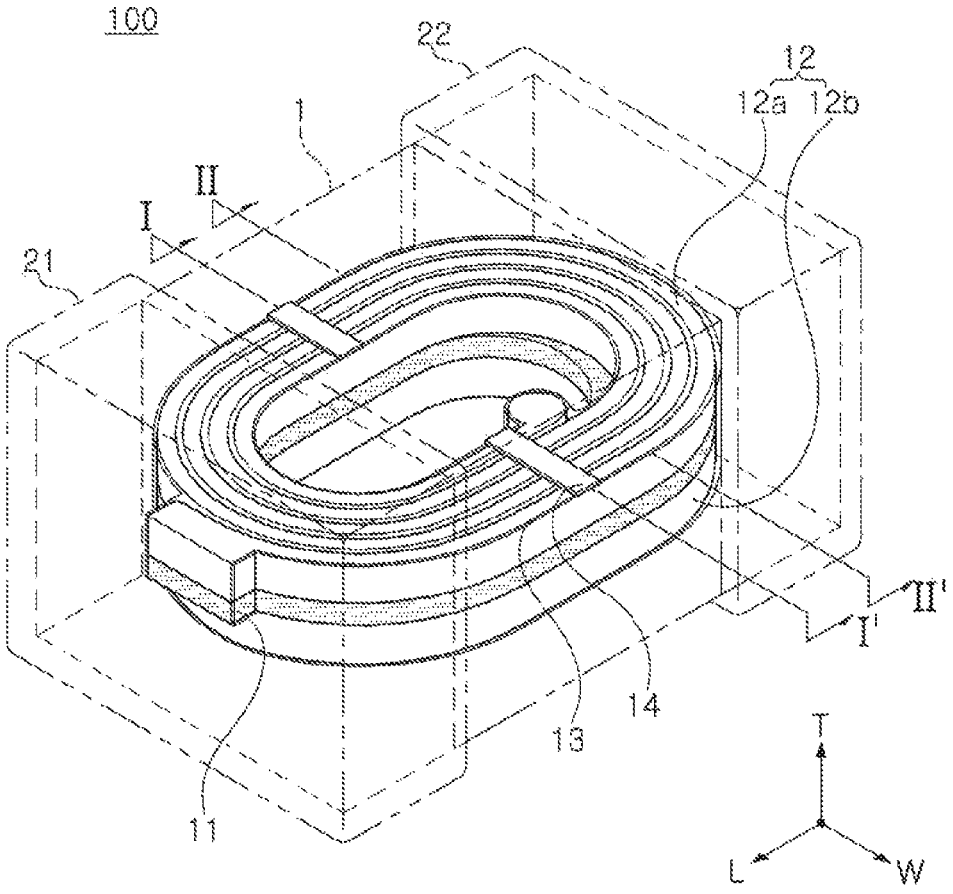
FIG. 1 is a schematic perspective view of an inductor according to an exemplary embodiment in the present disclosure.

FIG. 1 is a schematic perspective view of an inductor according to an exemplary embodiment in the present disclosure.

Referring to FIG. 1, an inductor 100 according to the exemplary embodiment may include a body 1 and first and second external electrodes 21 and 22 disposed on an outer surface of the body.

The body 1 may form an exterior of the inductor, have upper and lower surfaces opposing each other in a thickness (T) direction, first and second end surfaces opposing each other in a length (L) direction, and first and second side surfaces opposing each other in a width (W) direction, and be substantially a hexahedron. However, the body 1 is not limited thereto. The body 1 may include a magnetic material having magnetic characteristics. For example, the magnetic material in the body 1 may be ferrite or a material in which magnetic metal particles are filled in a resin. The magnetic metal particle may contain one or more selected from the group consisting of iron (Fe), silicon (Si), chromium (Cr), aluminum (Al), and nickel (Ni).

Meanwhile, a support member 11, and a coil 12 and an insulating wall 13 which are supported by the support member 11, may be disposed in the body 1 together with the magnetic material.

First, the support member 11 will be described. The function of the support member 11 is to forma thinner coil more easily. The support member may be an insulating substrate formed of an insulating resin. In this case, as the insulating resin, a thermosetting resin such as an epoxy resin, a thermoplastic resin such as polyimide, a resin in which a reinforcement material, such as a glass fiber or an inorganic filler, may be impregnated to form, for example, a prepreg, an ajinomoto build-up film (ABF), FR-4, a bismaleimide triazine (BT) resin, a photo-imagable dielectric (PID) resin, or the like, may be used. When the glass fiber is contained in the support member, rigidity may be more excellent. A through hole may be formed in a central portion of the support member, and filled with a magnetic material, thereby forming a core portion.

The coil 12 supported by the support member 11 may be formed on both upper and lower surfaces of the support member, as illustrated in FIG. 1, and composed of upper and lower coils 12*a* and 12*b*. The upper and lower coils 12*a* and 12*b* may be electrically connected to each other by a through via formed in the support member. As a result, the upper and lower coils 12*a* and 12*b* may be electrically connected to each other to form a single coil 12.

In addition to the coil 12, the insulating wall 13, disposed to contact a side surface of the coil 12, may also be supported by the support member 11. The insulating wall 13 may include an open-hole pattern having a shape corresponding to a coil pattern and have a structure in which the coil 12 is formed in a space of the open-hole pattern.

The insulating wall 13 may be formed of a single layer or a double layer composed of a first insulating wall disposed adjacent to the support member 11, and a second insulating wall disposed on the first insulating wall. When the insulating wall 13 is formed of the double layer, the first insulating wall may contain a photo-imagable dielectric (PID) material capable of being stripped by a stripping solution. For example, the first insulating wall may contain a photosensitive material containing a cyclic ketone compound and an ether compound having a hydroxyl group as main ingredients. The cyclic ketone compound may be, for example, cyclopentanone, or the like, and the ether compound having a hydroxyl group may be, for example, polypropylene glycol monomethyl ether, or the like. However the cyclic ketone compound and the ether compound are not limited thereto. Any photosensitive material may be used, as long as it may be easily stripped by the stripping solution. The second insulating wall disposed on the first insulating wall may contain a permanent type photosensitive insulating material, for example, a photosensitive material containing a bisphenol based epoxy resin as a main ingredient. When the insulating wall 13 is formed of the single layer, it is preferable that the insulating wall contain a bisphenol based epoxy resin as a permanent type photosensitive insulating material.

The insulating wall 13 may serve to prevent a short-circuit between coil patterns, such as an innermost coil pattern, an outermost coil pattern, and the like, in the coil, and serve to significantly increase an aspect ratio (AR) of the coil. An aspect ratio (AR) is a ratio of $T_c$ to $W_i$ (i.e $AR=T_c/W_i$) in which $W_i$ is a width of a portion of the coil pattern, determined in a plane parallel to a major surface of the support member and in a direction perpendicular to a direction along which the coil pattern winds to form the coil, and $T_c$ is a thickness of the same portion of the coil pattern determined in the thickness direction T.

Generally, since there is a need to increase a cross-sectional area of the coil, in order to decrease a direct current resistance Rdc, which is one of the main characteristics of the inductor, a method of increasing a width or thickness of the coil pattern in the coil may be used. However, in the case of increasing the width of the coil pattern, the short-circuit between coil patterns adjacent to each other may occur frequently, and, in a case of increasing a height of the coil pattern as compared to the width of the coil pattern, stability of the coil pattern and stability between the coil pattern and an adjacent structure supporting the coil pattern may be significantly decreased.

The inductor according to the present disclosure may include the insulating wall supported by the support member, such that an occurrence of the short-circuit may be prevented, and the inductor may include the insulating wall together with an insulating ribbon 14, to be described below, such that a coil component capable of being structurally stable while increasing the AR of the coil pattern may be provided.

The insulating ribbon 14 may be disposed to cross from an outermost insulating wall to an innermost insulating wall corresponding thereto among the insulating walls, and an upper surface of the insulating wall and an upper surface of the coil may be alternately disposed below a lower surface of the insulating ribbon 14.

The insulating ribbon disposed in the inductor according to the present disclosure may be formed integrally with the insulating wall, which means that there is no structural boundary between the insulating ribbon and the insulating wall, and the insulating ribbon and the insulating wall form a single structure without a boundary between materials of the insulating ribbon and the insulating wall. Therefore, it is preferable that a material of the ribbon 14 be substantially the same as that of the insulating material. For example, the insulating ribbon 14 may contain the permanent type photosensitive insulating material.

Figure 2:
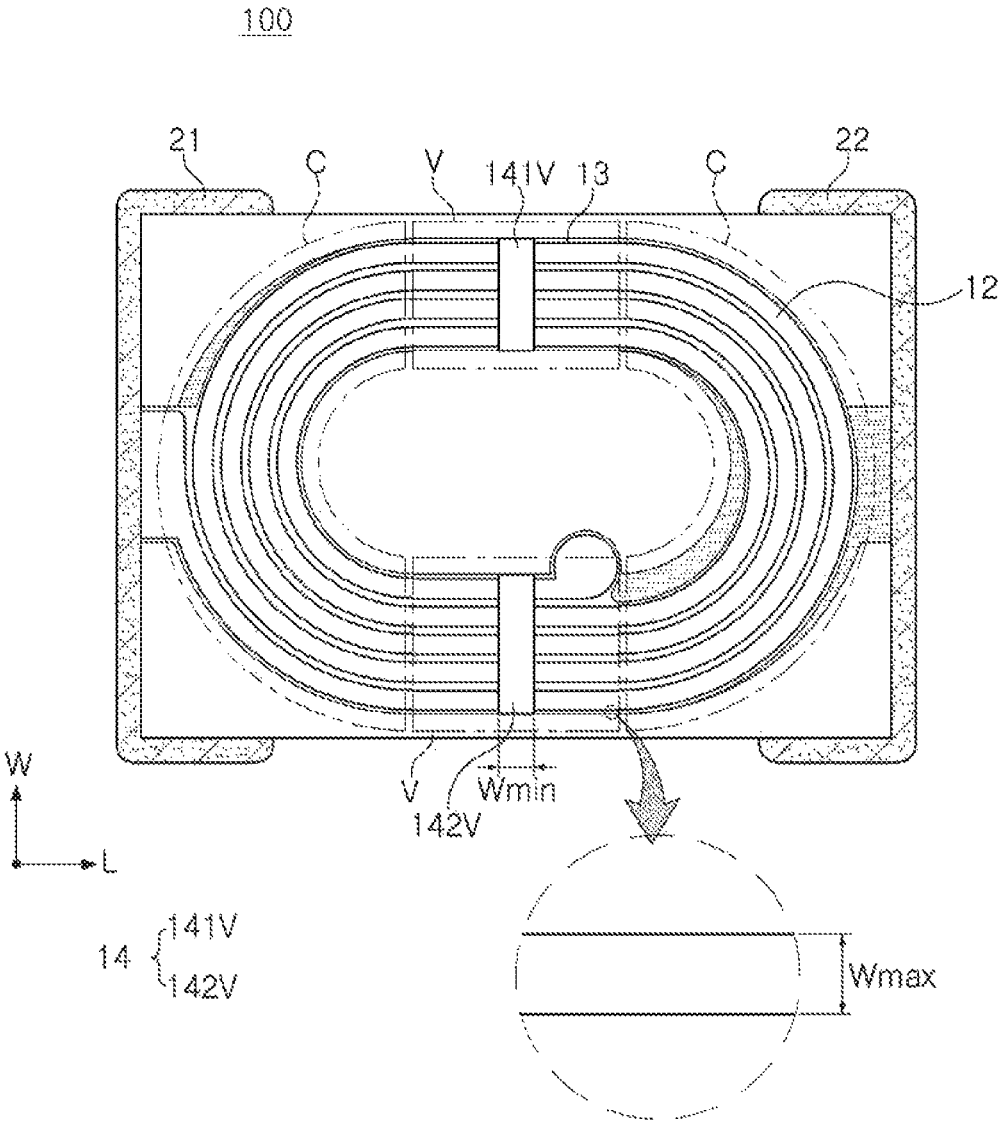
FIG. 2 is a top view of a coil and an insulating wall in the inductor of FIG. 1.

FIG. 2 is a top view of the coil 12 and the insulating wall 13 included in the inductor of FIG. 1. Referring to FIG. 2, the coil 12 may have a spiral shape, and the insulating wall 13 contacting the coil 12 may also have a spiral shape corresponding to the shape of the coil.

The spiral shape of the insulating wall 13 may alternately include a plurality of linear regions V and a plurality of curved regions C, and a linear region and a curved region may be alternately disposed, thereby forming a continuous spiral pattern. Here, the linear region and the curved region adjacent thereto may be distinguished based on a radius of curvature, and a set of points, at which a radius of curvature based on a central portion of the coil is 0, may be considered as the linear region, and a set of other points may be considered as the curved region.

Referring to FIG. 2, the insulating ribbon 14 may include first and second linear portion insulating ribbons 141V and 142V, disposed in directions toward the first and second side surfaces of the body in the width direction, respectively, based on the central portion of the core.

The first and second linear portion insulating ribbons 141V and 142V may preferably be disposed in linear regions having the longest length among linear regions of the outermost insulating wall and the innermost insulating wall, respectively.

The reason for this preference is that a section of the insulating wall contacting the side surface of the coil, being at risk of collapsing, to thereby deteriorate structural reliability, in the case of increasing the aspect ratio (AR) of the coil, is a section corresponding to the linear region of the insulating wall. Since, among the sections, a section including the linear region having the longest length is a section at which it is difficult to secure structural stability, in order to reinforce this section, the insulating ribbon may be added. The insulating ribbon may serve as a bridge in the region from the outermost insulating wall to the innermost insulating wall, thereby significantly improving structural reliability.

As illustrated in FIG. 2, the first and second linear portion insulating ribbons 141V and 142V may cross from the outermost insulating wall to the innermost insulating wall at the shortest length. As described above, when the upper surface of the outermost insulating wall is connected to the upper surface of the innermost insulating wall through the first and second linear portion insulating ribbons 141V and 142V, in the case of disposing each of the insulating ribbons 141 to be perpendicular to the outermost insulating wall and the innermost insulating wall, the insulating ribbons 141 may be structurally stable and be economically disposed.

A minimum width Wmin of the first or second linear portion insulating ribbon 141V or 142V may preferably be greater than a maximum width Wmax of the insulating wall. For example, the minimum width Wmin may preferably be 9 μm or more. A width of the first or second linear portion insulating ribbon 141V or 142V may be defined as an extension distance along a winding direction based on the winding direction of the coil pattern, and a length of the first or second linear portion insulating ribbon 141V or 142V may be defined as a length from the outermost insulating wall to the innermost insulating wall. Here, the minimum width may mean a narrowest width of an individual ribbon, and, in a case in which the insulating ribbon has a substantially rectangular cross-sectional shape, the width may be constant. When the minimum width of the insulating ribbon is not greater than the maximum width of the insulating wall, the insulating ribbon may not serve to firmly fix all of the insulating walls from the outermost insulating wall to the innermost insulating wall, which is not preferable.

Figure 3:
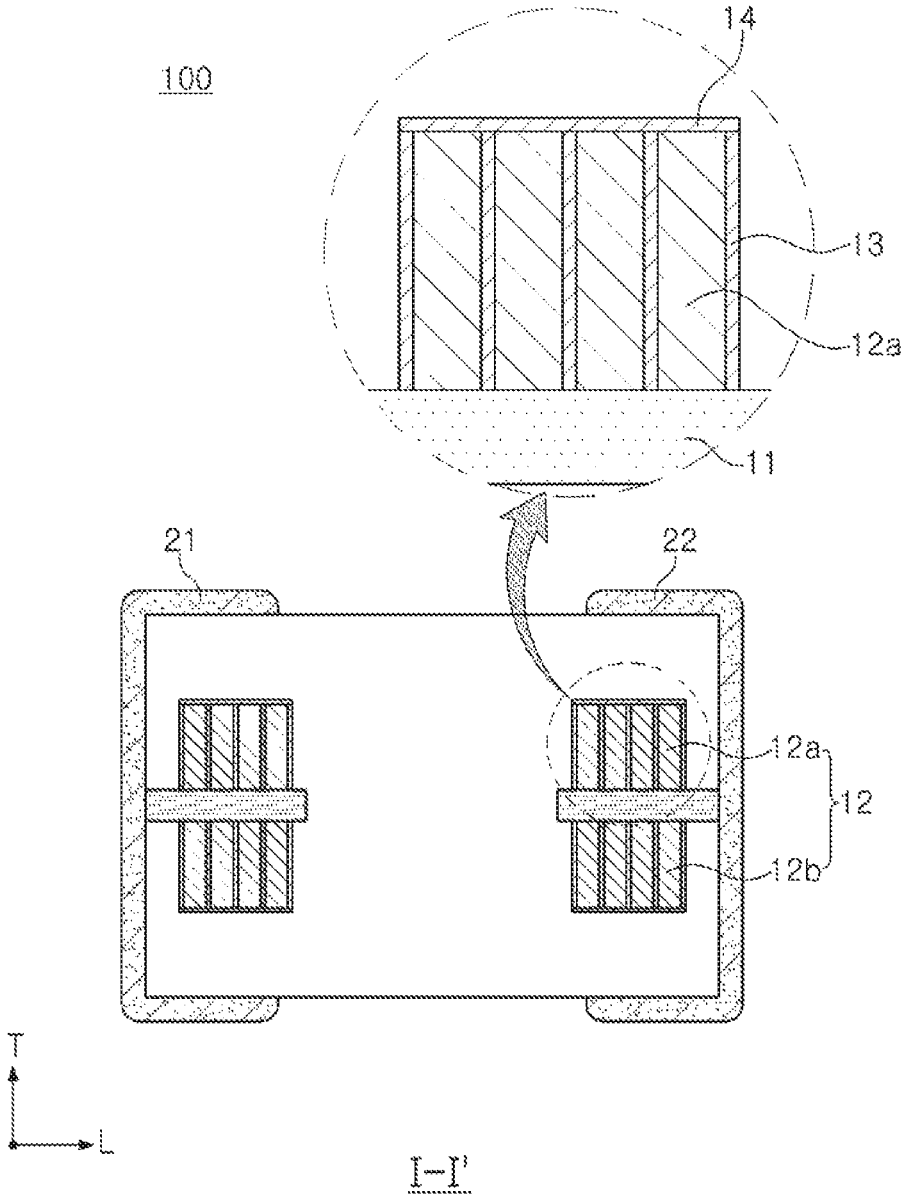
FIG. 3 is a cross-sectional view of the inductor taken along line I-I' of FIG. 1.

FIG. 3 is a cross-sectional view of the inductor taken along line I-I' of FIG. 1. Referring to FIG. 3, the upper and lower coils 12*a* and 12*b* disposed on the upper and lower surfaces of the support member 11, respectively, may be enclosed by the insulating wall disposed on the side surfaces thereof, the insulating ribbon 14 disposed on the upper surfaces thereof, and the support member 11 disposed on lower surfaces thereof. In particular, the coil 12 may have a structure in which the coil is formed in the open-hole pattern of the insulating wall. Here, a method of forming the coil in the open-hole pattern of the insulating wall is not limited, and a method of filling a conductive material therein by plating may be used. In this case, the insulating wall contacting the side surface of the coil may serve as a guide of plating growth.

Figure 4:
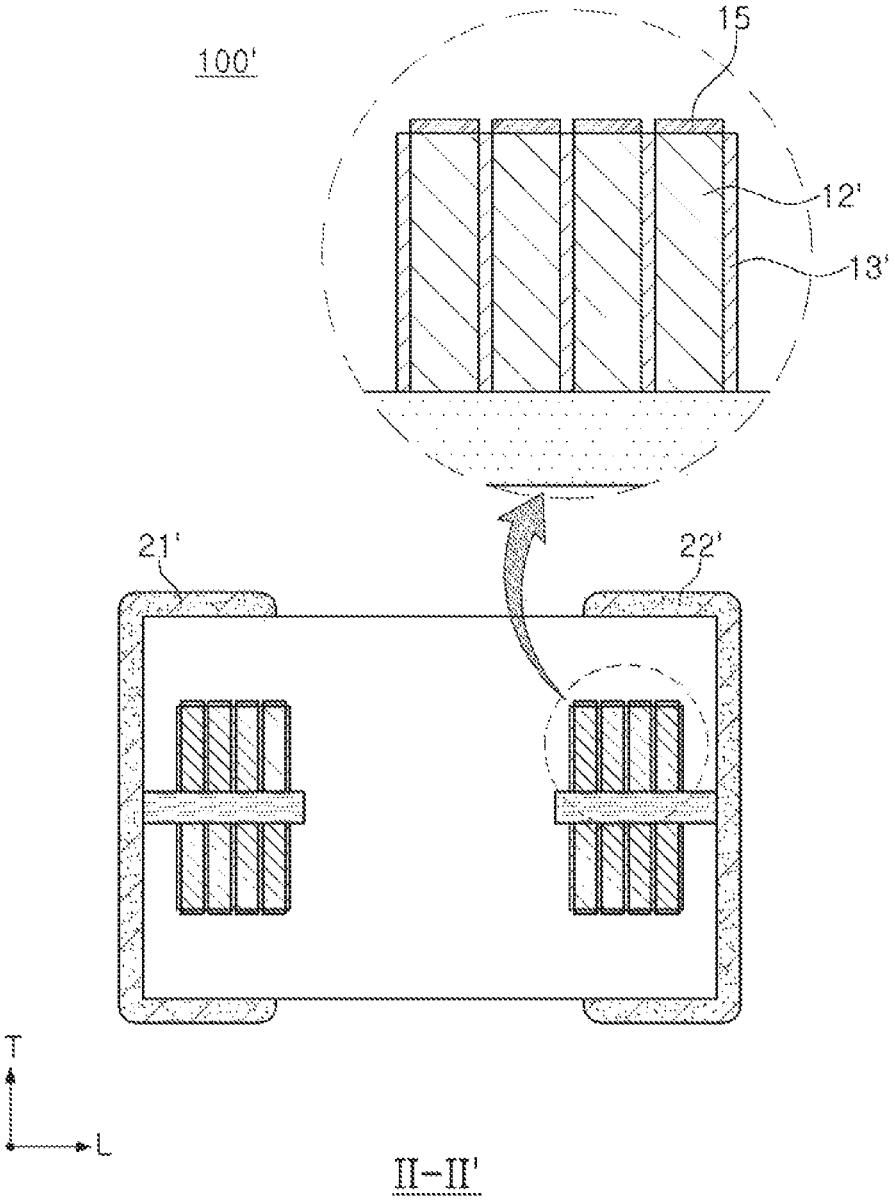
FIG. 4 is a cross-sectional view of a modified example of the inductor taken along line II-II' of FIG. 1.

FIG. 4 is a cross-sectional view of an inductor 100', which is a modified example of the inductor 100 of FIGS. 1 through 3. More specifically, FIG. 4 illustrates an inductor 100', additionally including an insulating layer 15 on an upper surface of a coil of a body of the inductor 100'.

For convenience of explanation, the inductor additionally including the insulating layer in the cross-sectional view taken along line II-II' of FIG. 1 is illustrated in FIG. 4.

Referring to FIG. 4, the insulating layer 15 may be further disposed on an upper surface of a coil 12', while being filled between open-hole patterns of an insulating wall 13'. The purpose of the insulating layer 15 may be to more certainly prevent a short-circuit between coil patterns adjacent to each other, and any insulating material may be used without limitation as long as it is used in a general insulating coating layer. For example, the insulating layer 15 may contain an epoxy resin, a polyimide resin, a liquid crystal polymer resin, or the like, but is not limited thereto.

It is preferable to form the insulating layer to have a substantially uniform thickness, but as long as inductance characteristics of the coil are not deteriorated, a thickness variation may be to some degree present, which does not matter. However, it may be preferable that a maximum thickness of the insulating layer is thinner than or the same thickness as a maximum thickness of an insulating ribbon disposed in the body of the inductor. The reason for this is that, in a case in which the maximum thickness of the insulating layer is greater than the maximum thickness of the insulating ribbon, the maximum thickness of the insulating layer is excessive, and thus the insulating layer unnecessarily occupies a space filled with the magnetic material in the body, which is not preferable.

Although not illustrated, the insulating layer 15 may be disposed on the upper surface of the coil on which the insulating ribbon is not disposed, and disposed on the upper surface of the coil to be extended to at least a portion of the insulating wall adjacent to the coil. In this case, a risk that foreign materials contained in the magnetic material, or the like, will infiltrate into a space between the coil and the insulating wall or that a short-circuit will occur between adjacent coils, due to a plating solution being released from the coil, may be clearly removed.

Figure 5A:
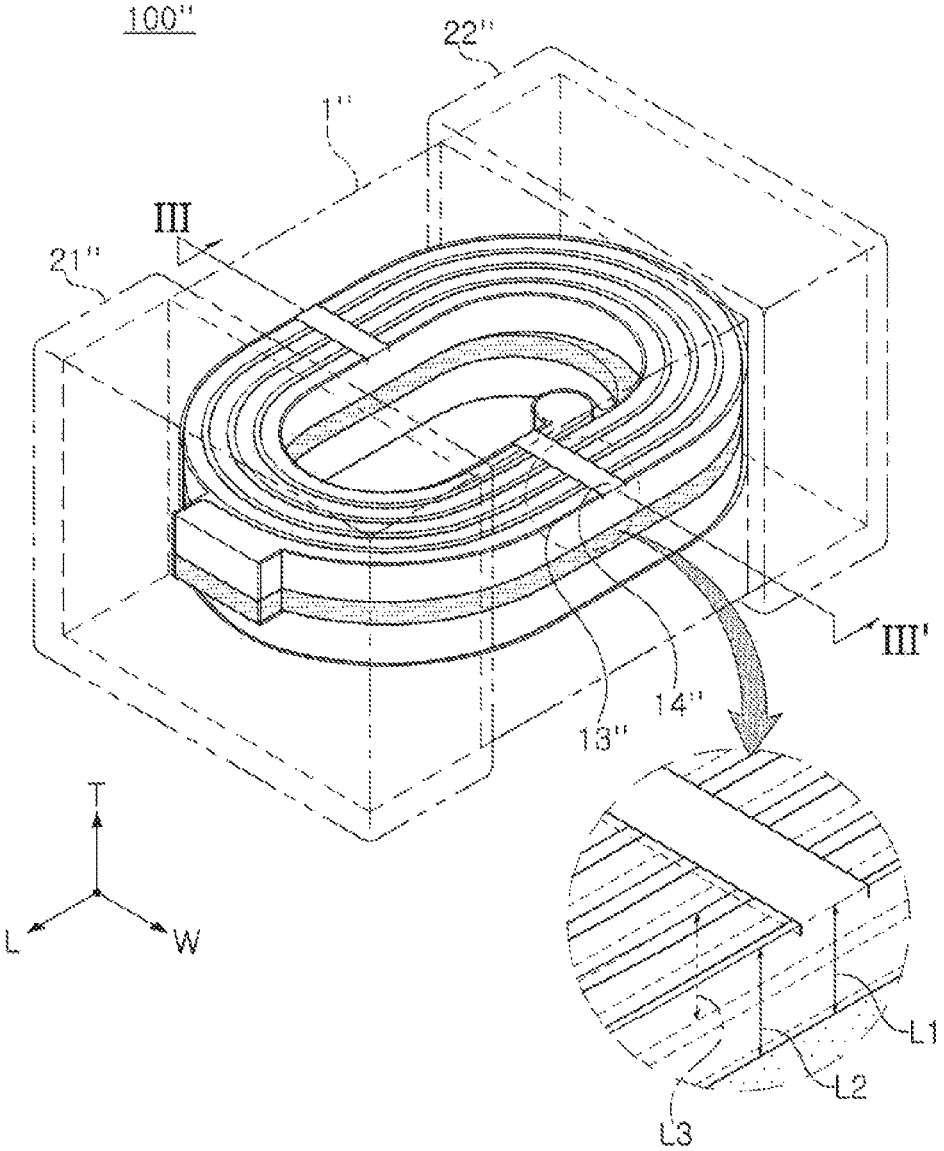
FIG. 5A is a schematic perspective view of the modified example of the inductor of FIG. 1.
Figure 5B:
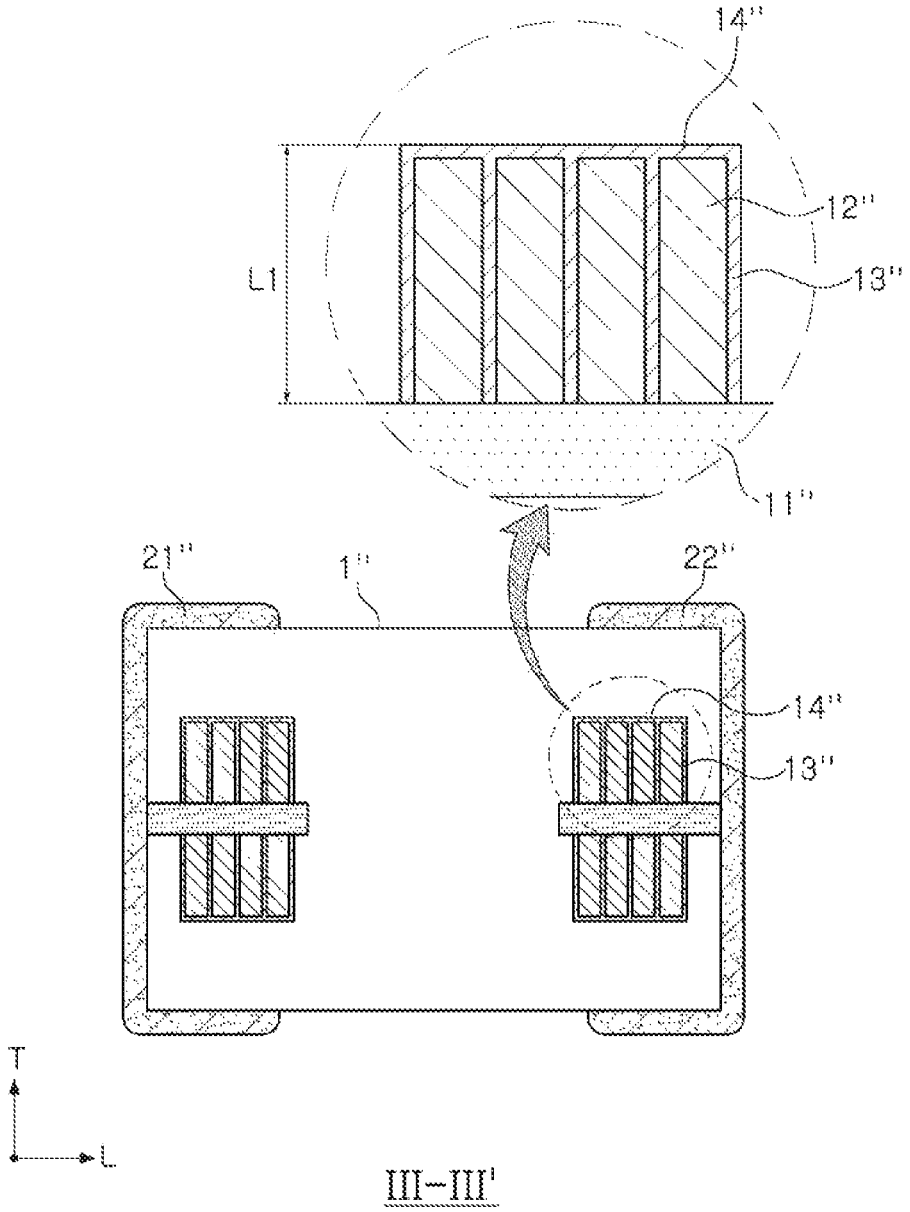
FIG. 5B is a schematic cross-sectional view of the inductor taken along line III-III' of FIG. 5A.

FIGS. 5A and 5B are a schematic perspective view and a schematic cross-sectional view, respectively, of an inductor 100", which is a modified example of the inductor 100 of FIG. 1. The inductor 100" illustrated in FIGS. 5A and 5B is characterized in that an insulating ribbon may be formed integrally with an insulating wall, as compared to the inductor 100 of FIG. 1. FIG. 5B is a cross-sectional view taken along line III-III' of FIG. 5A.

Referring to FIG. 5A, the inductor 100" may include a body 1" and external electrodes 21" and 22" disposed on an outer surface of the body.

Referring to FIGS. 5A and 5B, an insulating wall 13" and an insulating ribbon 14" may be formed integrally with each other so that a boundary therebetween is not readily apparent. A method of forming the insulating wall and the insulating ribbon integrally with each other is not limited. For example, an open-hole pattern of the insulating wall and the insulating ribbon may be simultaneously formed by controlling exposure and development conditions for forming a pattern while forming the open-hole pattern of the insulating wall. However, a specific method thereof is not limited.

Referring to FIGS. 5A and 5B, it is preferable that a height of the insulating ribbon 14", which is a distance L1 from a support member 11" to an upper surface of the insulating ribbon 14", be substantially the same as a distance L2 from an upper surface of the insulating wall 13" spaced apart from the insulating ribbon 14" in a winding direction of the coil 12" to the support member 11", and as a distance L3 from the support member 11" to the upper surface of the coil 12" disposed into the open-hole pattern of the insulating wall 13", respectively.

As a result, a height of the insulating ribbon contacting a magnetic material, a height of the upper surface of the coil contacting the magnetic material, and a height of the insulating wall contacting the magnetic material, may be substantially the same as each other, such that a structurally stable inductor may be provided without increasing an entire volume of the inductor including the coil.

When the insulating wall and the insulating ribbon are formed integrally with each other, as illustrated in FIGS. 5A and 5B, the height of the upper surface of the insulating ribbon may be decreased, and the number of processes for forming both the insulating wall and the insulating ribbon may be decreased by simultaneously forming the insulating ribbon while forming the open-hole pattern of the insulating wall, thereby promoting miniaturization of the inductor and simplification of the process.

Further, an additional insulating layer, or the like, may be disposed on the upper surface of the coil on which the insulating wall is not formed, and the upper surface of the entire coil and the upper surface of the insulating wall may be applied with an insulating film. To this end, any method for improving insulation characteristics through design change by those skilled in the art may be used without limitation.

Figure 6A:
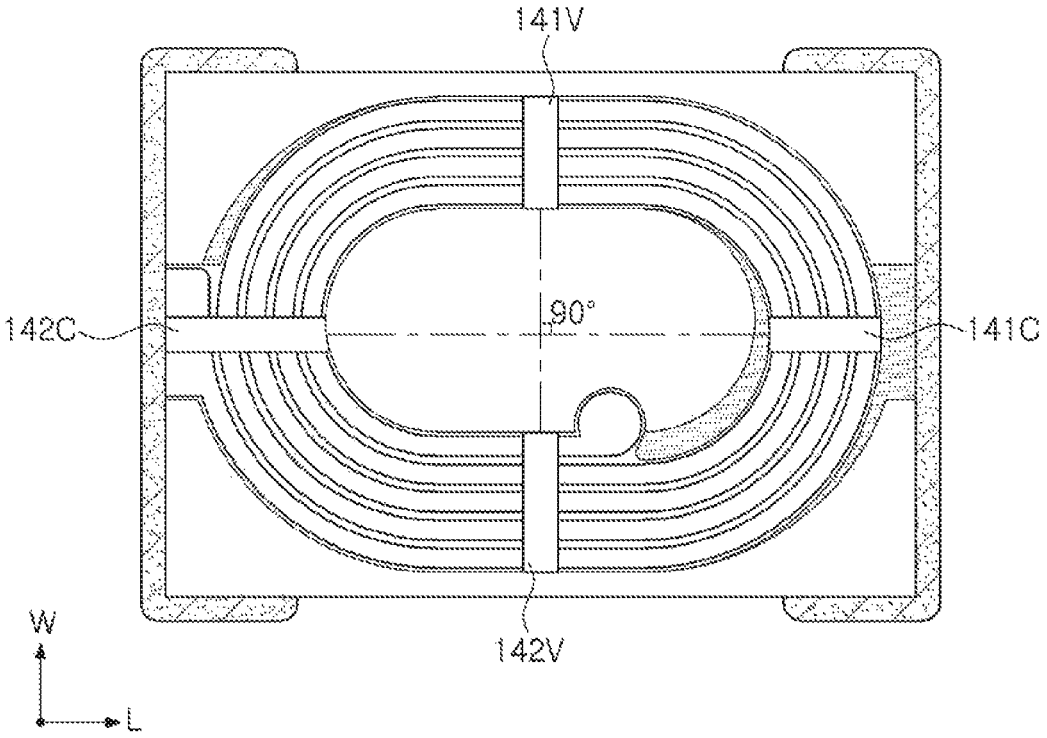
FIGS. 6A and 6B are front views of various modified examples of the inductor of FIG. 2.
Figure 6B:
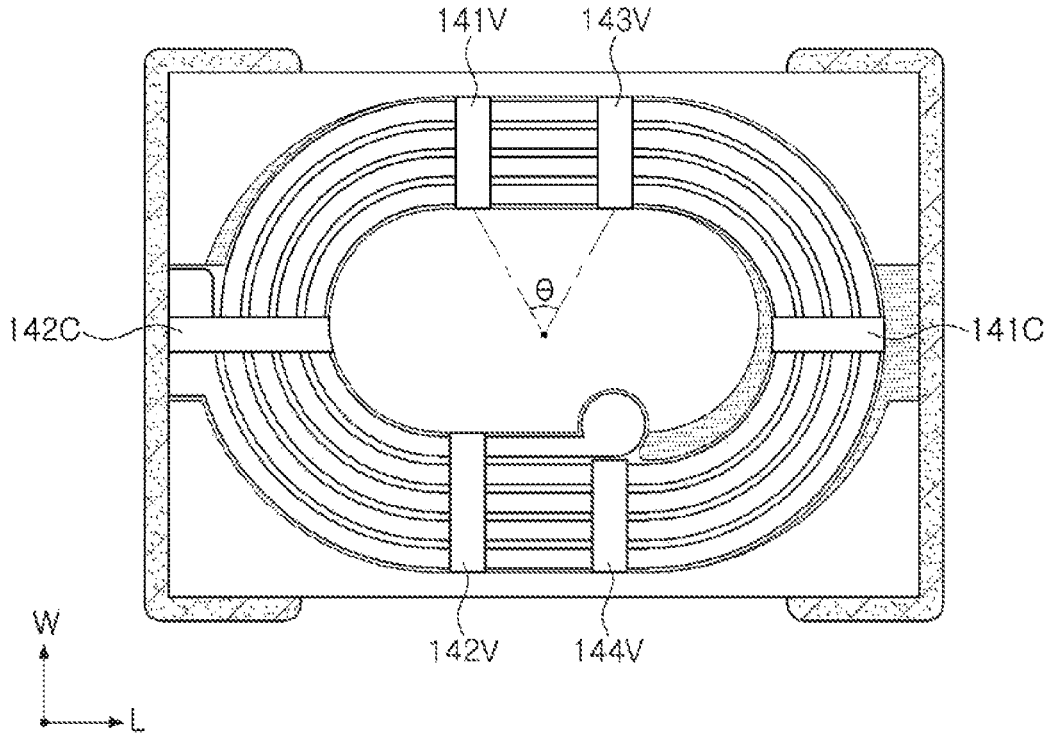

FIGS. 6A and 6B are front views of various modified examples of the inductor of FIG. 2. More specifically, FIGS. 6A and 6B illustrate inductors in which insulating ribbons serving as a bridge are disposed, in addition to the insulating ribbon 141V and 142V of FIG. 2. Additional disposition of the insulating ribbon is not limited to the modified examples to be described below, but, if necessary, the insulating ribbon may be appropriately added or omitted by those skilled in the art.

FIG. 6A illustrates a case in which the inductor additionally includes first and second curved portion insulating ribbons 141C and 142C in the curved regions adjacent to the linear regions of the insulating wall, in addition to the first and second linear portion insulating ribbons 141V and 142V.

The first linear portion insulating ribbon 141V, the first curved portion insulating ribbon 141C, the second linear portion insulating ribbon 142V, and the second curved portion insulating ribbon 142C, may be sequentially disposed in the winding direction of the coil. Each of the insulating ribbons 141V, 142V, 141C, and 142C may be disposed at an angle of 90° to the insulating ribbon adjacent thereto. The angle means an angle formed by the insulating ribbons adjacent to each other, based on directions from a central point of the core of the coil to inner ends of the insulating ribbons.

The insulating ribbons 141V, 142V, 141C, and 142C may be disposed on the upper surface of the coil and the upper surface of the insulating wall, to simultaneously serve as bridges, preventing collapse defects of the coil having a high aspect ratio and of the insulating wall which is adjacent to the coil and has a high aspect ratio, similar to the coil.

FIG. 6B illustrates a case in which the inductor further includes third and fourth linear portion insulating ribbons 143V and 144V, disposed in the linear regions of the insulating wall, in addition to the insulating ribbon 141V and 142V of FIG. 2, and first and second curved portion insulating ribbons 141C and 142C in the curved regions adjacent to the linear regions of the insulating wall.

FIG. 6B illustrates a case in which the structural stability of the insulating wall that is most unstable, in view of its structure, is reinforced by adding a large number of insulating ribbons in the linear region having the longest length in the outermost insulating wall.

Referring to FIG. 6B, it is not preferable that an angle (θ) formed by arbitrary insulating ribbons 141V and 143V, adjacent to each other, be less than 30°. The reason is as follows. The angle formed by adjacent insulating ribbons in this embodiment is less than 30°, which means that the insulating ribbons are excessively disposed. When the insulating ribbons are excessively disposed, structural stability may be secured, and thus collapse or bending of the insulating wall may be suitably prevented, but a process step and process cost for disposing the insulating ribbon may be increased, and, at the time of filling a plating solution in the open-hole pattern of the insulating wall, the plating may not be suitably performed. Therefore, it is preferable that an angle formed by arbitrary insulating ribbons be between 30° and 330°, and in consideration of only an acute angle, right angle, obtuse angle, or straight angle, the angle formed by arbitrary insulating ribbons may preferably be in a range of 30° to 180°.

Figure 7:
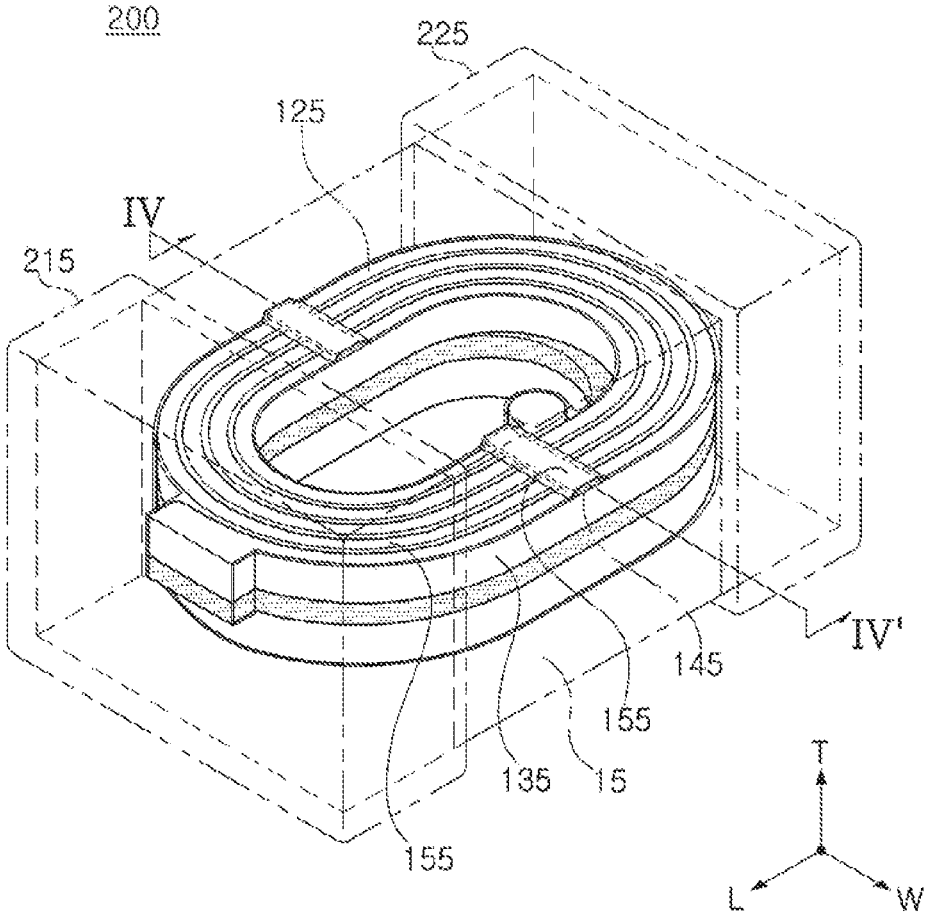
FIG. 7 is a schematic perspective view of an inductor according to another exemplary embodiment in the present disclosure.
Figure 8:
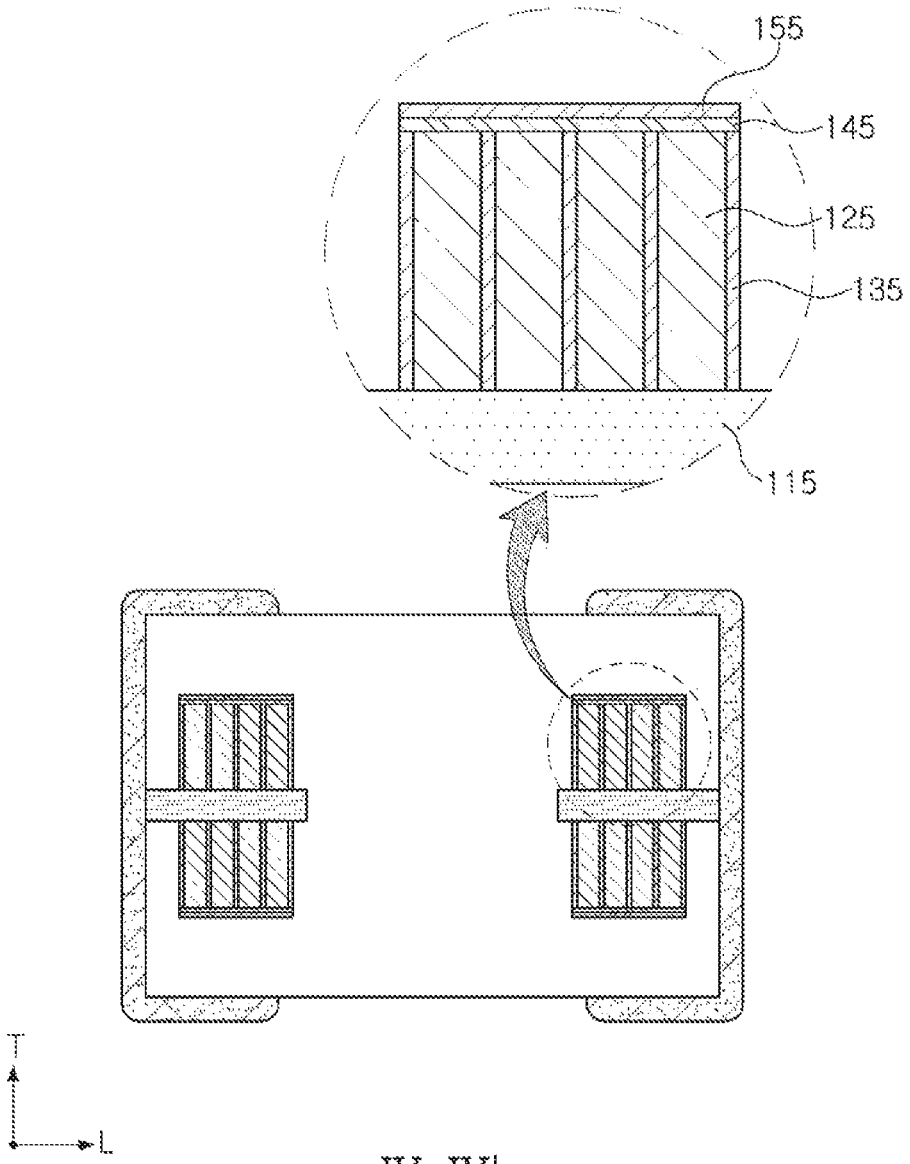
FIG. 8 is a cross-sectional view of the inductor taken along line IV-IV' of FIG. 7.

FIG. 7 is a schematic perspective view of an inductor according to another exemplary embodiment in the present disclosure; and FIG. 8 is a cross-sectional view of the inductor taken along line IV-IV' of FIG. 7.

Except for the disposition of an insulating layer 155, the other components of an inductor 200 of FIGS. 7 and 8 are with the same as those in the above-mentioned inductors 100, 100' and 100". Therefore, a detailed description of the other components will be omitted, and the insulating layer 155 of FIGS. 7 and 8 will primarily be described.

Referring to FIGS. 7 and 8, the inductor 200 according to another exemplary embodiment in the present disclosure may include a body 15 including a magnetic material and embedding a coil 125, and first and second external electrodes 215 and 225 disposed on an outer surface of the body. A side surface of the coil 125 may be disposed to contact an insulating wall 135 including an open-hole pattern, and an insulating ribbon 145 may be disposed on upper surfaces of the insulating wall and the coil, to cross from an outermost insulating wall to an innermost insulating wall.

Meanwhile, the insulating layer 155 may be disposed on an upper surface of the insulating ribbon 145 and a region of the upper surface of the coil that is not covered by the insulating ribbon.

Since the upper surface of the coil 125 of the inductor 200 of FIGS. 7 and 8 is covered by the insulating layer 155 or by a double layer of the insulating ribbon 145 and the insulating layer 155, the upper surface of the coil 125 is not substantially exposed to the outside. As a result, a short-circuit occurring between coils adjacent to each other may be clearly prevented.

Meanwhile, although not specifically illustrated, the insulating layer 155 may also be applied on a side surface of the insulating ribbon 145, such that the insulating layer may be continuously formed to form a pattern corresponding to the open-hole pattern of the insulating wall and a spiral pattern of the coil. In this case, disposition of the insulating layer 155 may be simplified, and insulation characteristics may be improved.

With the inductors 100, 100' and 100" according to the exemplary embodiment, and the inductor 200 according to another exemplary embodiment described above, the inductor including a coil having a high aspect ratio may be structurally stably formed. As a result, direct current resistance Rdc characteristics may be significantly improved.

As set forth above, according to exemplary embodiments in the present disclosure, the inductor including the structurally stable coil pattern having a high aspect ratio of 3:1 or more may be obtained.

While exemplary embodiments have been shown and described above, it will be apparent to those skilled in the art that modifications and variations could be made without departing from the scope of the present invention, as defined by the appended claims.

What is claimed is:

1. An inductor comprising:

a body including a magnetic material, a support member, a coil supported by the support member, and a plurality of insulating walls supported by the support member and disposed around a central portion of the body; and external electrodes disposed on an outer surface of the body and electrically connected to the coil, wherein the coil includes a plurality of conductive sections disposed around the central portion of the body, each of the plurality of conductive sections has a lower surface contacting the support member, an upper surface opposing the lower surface, and side surfaces connecting the upper and lower surfaces to each other and being in contact with adjacent insulating walls of the plurality of the insulating walls, a first insulating ribbon is disposed on portions of upper surfaces of portions of the plurality of insulating walls, and on portions of upper surfaces of first conductive sections of the plurality of conductive sections, and an upper surface of each of second conductive sections of the plurality of conductive sections respectively extending from the first conductive sections is directly covered by a material different from that of the first insulating ribbon.

2. The inductor of claim 1, wherein the first insulating ribbon and the plurality of insulating walls are an integral piece of the same material.

3. The inductor of claim 1, wherein the first insulating ribbon extends from an outermost insulating wall among the plurality of insulating walls to an innermost insulating wall among the plurality of insulating walls at a shortest distance.

4. The inductor of claim 1, wherein the plurality of insulating walls are spaced apart from each other, and the plurality of conductive sections are disposed in spaces between the plurality of insulating walls, respectively.

5. The inductor of claim 1, wherein the plurality of insulating walls include a plurality of linear regions and a plurality of curved regions, the linear regions and the curved regions being alternately disposed to form a continuous pattern, the first insulating ribbon extends from a linear region of an outermost insulating wall to a linear region of an innermost insulating wall at a shortest distance, and the inductor further comprises a second insulating ribbon extending from a curved region of the outermost insulating wall to a curved region of the innermost insulating wall at a shortest distance.

6. The inductor of claim 5, wherein the inductor further includes a third insulating ribbon disposed on an opposite side of the central portion of the coil with respect to the first insulating ribbon, and the first and third insulating ribbon are disposed in linear regions having a longest length among the linear regions of the outermost insulating wall, respectively, and an angle between a direction from an inner end of the first insulating ribbon to the central portion of the coil and a direction from an inner end of the third insulating ribbon to the central portion of the coil is 180°.

7. The inductor of claim 5, wherein an angle between a direction from an inner end of the first insulating ribbon to the central portion of the coil and a direction from an inner end of the second insulating ribbon to the central portion of the coil is 90°.

8. The inductor of claim 1, wherein an angle between a direction from an inner end of the first insulating ribbon to the central portion of the coil and a direction from an inner end of the second insulating ribbon to the central portion of the coil is 30° to 330°.

9. The inductor of claim 1, wherein a minimum width of the first insulating ribbon is greater than a maximum width of each of the plurality of insulating walls.

10. The inductor of claim 1, further comprising an insulating layer disposed on an upper surface of the coil and made of a material different from the first insulating ribbon.

11. The inductor of claim 10, wherein a maximum thickness of the insulating layer is thinner than a maximum thickness of the first insulating ribbon.

12. The inductor of claim 10, wherein the insulating layer extends from the upper surface of the coil to at least a portion of the upper surface of the plurality of insulating walls adjacent to the coil.

13. The inductor of claim 1, wherein a material of the plurality of insulating walls and the first insulating ribbon includes a bisphenol based epoxy resin.

14. The inductor of claim 1, further comprising:

an insulating layer disposed on an upper surface of the first insulating ribbon and a region of the upper surface of the coil that is not covered by the insulating ribbon.

15. The inductor of claim 14, wherein a side surface of the first insulating ribbon contacts the insulating layer.

16. The inductor of claim 14, wherein the plurality of insulating walls includes a plurality of linear regions and a plurality of curved regions, the linear regions and the curved regions being alternately disposed to form a continuous pattern, and the first insulating ribbon is disposed in a linear region having a longest length among the linear regions, and the inductor further comprises a second insulating ribbon disposed in a point shifted by ½ turn from the first insulating ribbon along the upper surface of the coil.

17. The inductor of claim 1, wherein the body includes a magnetic material surrounding a structure comprised of the support member, the coil, the plurality of insulating walls, and the first insulating ribbon, wherein in a direction perpendicular to a major surface of the support member, a smallest distance from the magnetic material to the portions of the plurality of insulating walls covered by the first insulating ribbon is greater than a smallest distance from the magnetic material to other portions of the plurality of insulating walls not covered by the first insulating ribbon.

18. The inductor of claim 17, wherein in the direction perpendicular to the major surface of the support member, a smallest distance from the magnetic material to the first conductive sections is greater than a smallest distance from the magnetic material to the second conductive sections.

19. The inductor of claim 17, further comprising one or more insulating ribbons spaced-apart from each other and from the first insulating ribbon.

20. The inductor of claim 17, further comprising an insulating layer covering the other portions of the plurality of insulating walls not covered by the first insulating ribbon, the second conductive sections, and the first insulating ribbon.

21. The inductor of claim 1, further comprising:

a second insulating ribbon spaced apart from the first insulating ribbon, and disposed on portions of upper surfaces of other portions of the plurality of insulating walls and on portions of upper surfaces of third conductive sections of the plurality of conductive sections, wherein the third sections connect the first sections and the second sections to each other, respectively, and the first and second insulating ribbons are disposed on opposing sides of the central portion.

22. The inductor of claim 1, further comprising:

an insulating layer disposed on an upper surface of the coil and including a plurality of grooves corresponding to the plurality of insulating walls, respectively.

23. The inductor of claim 22, wherein the plurality of grooves end at the first insulating ribbon.

* * * * *